United States Patent [19]

Folden et al.

[11] 3,951,385

[45] Apr. 20, 1976

[54] TENSION BAND

[75] Inventors: Clarence Lee Folden, Downers Grove; Nicholas D. Reidy, Chicago, both of Ill.

[73] Assignee: Sears, Roebuck and Co., Chicago, Ill.

[22] Filed: Dec. 16, 1974

[21] Appl. No.: 533,129

[52] U.S. Cl. ..... 256/47

[51] Int. Cl.[2] ..... B21F 27/00

[58] Field of Search ..... 256/47, 34, 24, 33

[56] References Cited

UNITED STATES PATENTS 2,997,278 8/1961 Pinson ..... 256/47

*Primary Examiner*—Paul R. Gilliam
*Assistant Examiner*—Doris L. Troutman
*Attorney, Agent, or Firm*—Arnstein, Gluck, Weitzenfeld & Minow

[57] ABSTRACT

A tension band for retaining a chain link fence fabric tension bar to a support post for maintaining the fence fabric under tension. The tension band comprises a generally flat unitary sheet metal member having a circular opening to receive a support post and reduced opening to receive a tension bar. The reduced opening is elongated and lies on a line generally tangent to the circular opening.

6 Claims, 5 Drawing Figures

TENSION BAND

BACKGROUND OF THE INVENTION

This invention relates to a tension band for attaching a stretcher or tension bar to a fence post.

The general practice of assembling fences of the wire mesh fabric or chain link type is to insert a vertical tension bar into the loops at each end of a fence fabric and then to connect the bars to fence posts by means of tension bands. Heretofore, these bands have been relatively complicated and expensive to manufacture and, in some instances, requiring the use of nuts and bolts which currently are costly and in short supply in the market. Furthermore, the bolts form projections beyond the plane of the fence, which are objectionable and hazardous.

SUMMARY OF THE INVENTION

It is an object of the present invention to provide a tension band which comprises a simple single unitary structure which may be fabricated, as by stamping from sheet metal, in one operation.

Another object of this invention is the provision of a tension band which has a high degree of rigidity, strength and high resistance to deformation when subjected to tensile stresses.

A further object of this invention is the provision of a tension band which does not utilize bolts and which is devoid of projections beyond the plane of the fence.

Still another object of this invention is the provision of a tension band which may be easily and quickly installed by relatively unskilled labor.

Other and further objects and advantages of this invention will become apparent from the following description when the same is considered in connection with the accompanying drawings.

BRIEF DESCRIPTION OF A PREFERRED EMBODIMENT

Figure 1:
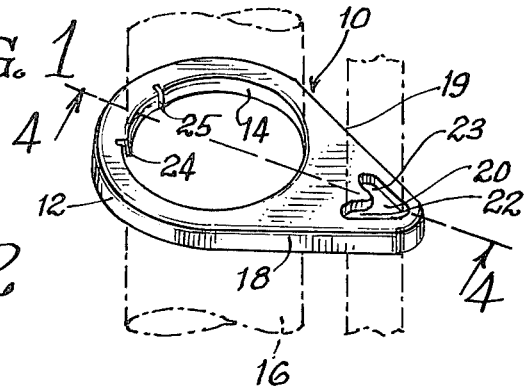
FIG. 1 is a perspective view of a tension band in accordance with the present invention.
Figure 5:
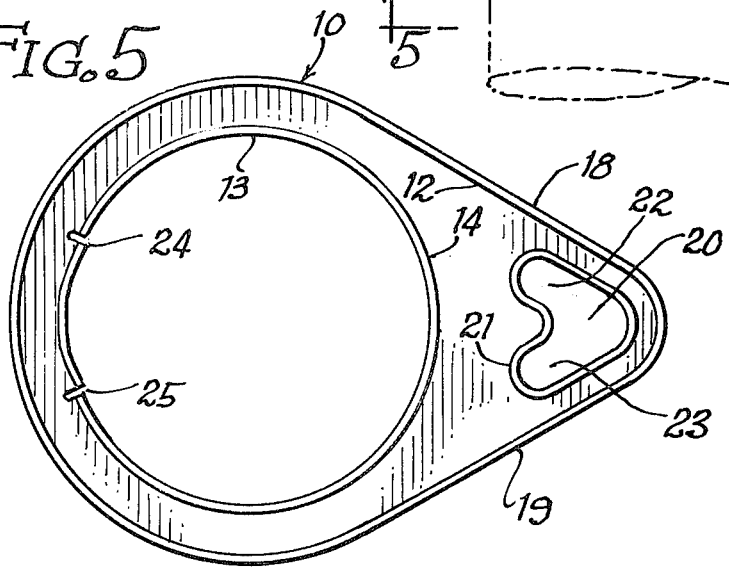
FIG. 5 is a bottom plan view of the tension band, looking in the direction of the arrows 5—5 of FIG. 4.

Referring to FIGS. 1 and 5, the tension band of the present invention is formed, as by stamping, from suitable sheet metal into a unitary member 10 generally pear-shaped in plan, substantially as illustrated. The member 10 is provided with a depending uninterrupted flange 12 coextensive with the perimeter thereof. A circular opening 13 is provided in the wide portion 11 of member 10 and this opening is enclosed by a depending peripheral flange 14. Preferably, the diameter of the opening 13 is sufficiently large to snugly accommodate a standard tubular post 16. The flange 14 embraces the post 16 and normally maintains the member 10 substantially in an adjusted horizontal plane in relation to the vertical axis of the post, in the course of assembly.

The narrow portion 17 of the member 10 is generally triangular, in plan, with the sides 18 and 19 being tangent to the periphery of the wide portion 11. Portion 17 is provided with a V-shaped opening 20 spaced inwardly from the flange 12. The marginal edges of the opening 20 are bent downwardly to form a depending flange 21 coextensive with the opening 20. The legs 22 and 23 of the opening 20 extend in substantially parallel relation to corresponding respective sides 18 and 19 of portion 17 and are so arranged that a median line drawn through each of the legs 23 and 23 would be substantially tangent to the circular opening 13. Preferably, the flange 14 is notched in two places, as at 24 and 25, as shown clearly in FIGS. 1 and 3, for a purpose as will be hereinafter explained.

In assembly, or installation of the fence, preferably, three tension bands 10 are conventionally employed in vertically spaced relation on a post 16. In the present instance, the bands 10 of my invention are slipped over the post 16 and moved to top, middle and bottom positions.

The conventional manufacturing tolerances for iron pipe which comprises the post 16 are taken into consideration in determining the dimensions of the opening 13. Obviously, the most desirable condition would be a snug fit relationship between the tension band 10 and the post 16, such that the tension band 10 could be moved relatively freely on the post 16 but, thereafter, would remain in a fixed position during installation of the other fence components. However, the opening 13, in any event, must be sufficiently large to accommodate any post of corresponding size, including a post having a diameter which is at the upper limit of its dimensional tolerance. Thus, it will be apparent that, if a post has a diameter which is at the lower end of the tolerance range, there will be excessive clearance between the post and the flange 12 so that the tension band 10 would tend to slide to the bottom of the post and would not remain in a fixed position thereon for assembly purposes. In such event, the flange portion between the notches 24 and 25 may easily be bent inwardly into the opening 13, as with a pair of pliers, thereby slightly constricting the opening 13 so as to effect frictional engagement between the flange 14 and the post 16 sufficient to retain the tension band 10 in an adjusted position.

Figure 2:
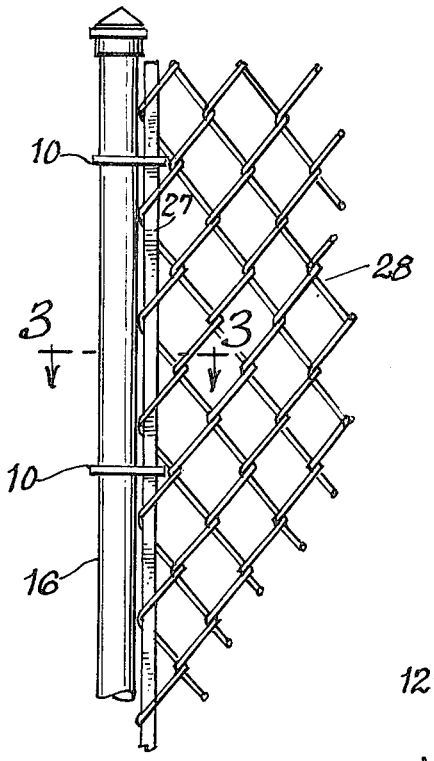
FIG. 2 is a fragmentary elevational view showing multiple tension bands of the present invention assembled in operative position on a fence structure.
Figure 3:
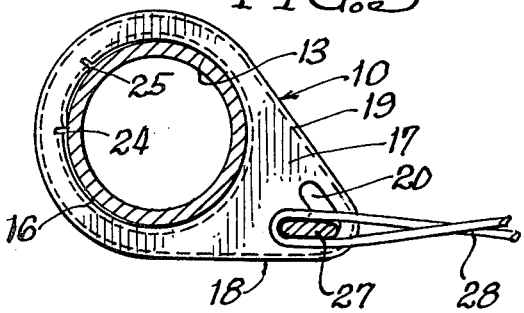
FIG. 3 is a cross-sectional view, on an enlarged scale, taken on line 3—3 of FIG. 2.
Figure 4:
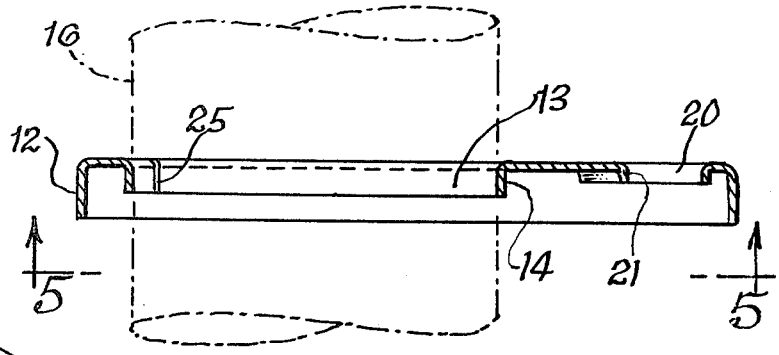
FIG. 4 is a vertical cross-sectional view, on an enlarged scale, taken on line 4—4 of FIG. 1.

As illustrated in FIGS. 2 and 3 a conventional flat tension bar 27 is passed through corresponding vertically aligned legs 23 of the opening 20 and the end loops of the fence fabric 28 are secured in a conventional manner. It will be seen that in assembled relation the tension bands 10 are arranged angularly on the post 16 so that the tension bars 27 are disposed co-planar with the fence fabric 28, which is under tension, with the plane of the fabric being substantially tangent to one side of the post 16 and offset from a vertical plane passing through the centers of a plurality of linearly alined posts 16. It will be understood that when the tension bar is inserted in the other leg 22 of the V-shaped opening 20 and the fence fabric 28 placed under tension, the fabric will be disposed in a plane tangent to the opposite side of the post 16.

Thus, it will be seen that we have provided a tension band which comprises a single part, which has high rigidity and strength, which may be economically manufactured, and which can be easily assembled without the use of bolts.

Various changes coming within the spirit of our invention may suggest themselves to those skilled in the art; hence, we do not wish to be limited to the specific embodiments shown and described or uses mentioned, but intend the same to be merely exemplary, the scope of our invention being limited only by the appended claims.

We claim:

1. A tension band for retaining a chain link fence fabric tension bar to a support post for maintaining the fence fabric under tension comprising, a generally flat planar unitary member having a circular opening to receive a support post and generally V-shaped opening spaced from said circular opening to receive a tension bar, the leg portions of said V-shaped opening lying on respective lines generally tangent to respective opposite sides of said circular opening so that the fence fabric when under tension may be selectively disposed in a plane generally tangent to one or the other side of said post.

2. The invention as defined in claim 1 in which the member is formed of sheet metal and is provided with a perimetric rigidifying flange.

3. The invention as defined in claim 1 in which the member is formed of sheet metal and the circular opening is enclosed by a depending flange.

4. The invention as defined in claim 3 is which the flange is notched to permit deformation of a portion of the flange.

5. The invention as defined in claim 1 in which tension band is generally pear shaped.

6. A tension band for retaining a chain link fence fabric tension bar to a support post for maintaining the fence fabric under tension comprising, a generally flat planar unitary member having a circular opening to receive a support post, and a second opening to receive a tension bar, said second opening being spaced from said first opening and being generally triangular in shape with adjacent two sides of said second opening lying or respective lines generally tangent to opposite sides of said circular opening, said tension bar when selectively positioned in registration with one of said fence fabric when under tension in a plain generally tangent to one or the other side of said post.

* * * * *

UNITED STATES PATENT OFFICE

CERTIFICATE OF CORRECTION

PATENT NO. : 3,951,385

DATED : April 20, 1976

INVENTOR(S) : Clarence Lee Folden and Nicholas D. Reidy

It is certified that error appears in the above-identified patent and that said Letters Patent are hereby corrected as shown below:

Column 4, line 17, "or" should read --on--.

Column 4, line 19, after "one" insert --side--.

Column 4, line 19, after "of" insert --a support post when--.

Column 4, line 20, delete "when" and insert --is--.

Column 4, line 20, after "tension" insert --being disposed--.

Column 4, line 20, "plain" should read --plane--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*